US006260250B1

(12) United States Patent
Hall et al.

(10) Patent No.: US 6,260,250 B1
(45) Date of Patent: Jul. 17, 2001

(54) APPARATUS FOR USE IN ADJUSTING THE LIE AND/OR LOFT ANGEL OF A GOLF CLUB HEAD

(75) Inventors: J. Neil Hall, Carlsbad; Ronald K. Hettinger, Oceanside, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/218,734

(22) Filed: Dec. 22, 1998

(51) Int. Cl.[7] ..... A63B 57/00
(52) U.S. Cl. ..... 29/281.1; 269/909; 269/285
(58) Field of Search ..... 150/160; 29/281.1, 29/281.5, 283; 269/285, 286, 909, 287, 254 R

(56) References Cited

U.S. PATENT DOCUMENTS

| | | | | |
|---|---|---|---|---|
| 1,575,023 | | 3/1926 | Walton . | |
| 3,478,799 | * | 11/1969 | Hoyt | 150/160 |
| 3,593,769 | * | 7/1971 | Spears | 150/160 |
| 3,980,301 | | 9/1976 | Smith . | |
| 4,378,832 | * | 4/1983 | Thompson | 206/315 R |
| 4,597,577 | | 7/1986 | Lamanna . | |
| 4,685,682 | | 8/1987 | Isabell . | |
| 4,715,601 | | 12/1987 | Lamanna . | |
| 4,804,184 | | 2/1989 | Maltby . | |
| 4,842,243 | | 6/1989 | Butler . | |
| 4,984,794 | | 1/1991 | Pernelle et al. . | |
| 5,626,582 | | 5/1997 | Toulon . | |
| 5,749,790 | | 5/1998 | Van Alen, II et al. . | |
| 6,116,307 | * | 9/2000 | Mangigian et al. | 150/160 |

* cited by examiner

*Primary Examiner*—Robert C. Watson
(74) *Attorney, Agent, or Firm*—Michael A. Catania

(57) ABSTRACT

A bending plate for use in adjusting a lie and/or loft of a golf club head. The bending plate comprises means for minimizing or reducing mechanical stresses within a face region and face insert plate of the golf club head, when the golf club head is placed in a clamping apparatus. Thus, the bending plate protects the face insert plate of the club head during a lie and/or loft adjustment of the club head. The bending plate also includes means for establishing proper positioning of the bending plate over the face insert plate and/or face region of the golf club head.

2 Claims, 5 Drawing Sheets

APPARATUS FOR USE IN ADJUSTING THE LIE AND/OR LOFT ANGEL OF A GOLF CLUB HEAD

BACKGROUND

The present invention relates generally to golf clubs and, more particularly, to an apparatus and method for reducing stresses within a face insert plate section of a golf club head when a lie and/or loft angle of the golf club head is to be adjusted.

It has been observed that, when golf club heads having face insert plates are placed within conventional clamping mechanisms and forces are applied to the hosel regions of those golf club heads, substantial damage may result to the face insert region of the golf club heads. This damage may take the form of cracks that appear within the face insert plates, partial or total separation of the face insert plates from their respective golf club heads and/or loss of epoxy filler or bonding agent from regions between the face insert plates and remaining portions of the face sections of the golf club heads.

Thus, it is submitted that those skilled in the art would find to be quite useful an apparatus and method for relieving stresses within a face region of a golf club head, when a lie and/or loft angle of the golf club head is to be adjusted.

SUMMARY OF THE INVENTION

The present invention is directed to an apparatus and method for reducing stresses within a face region of a golf club head, when a lie and/or loft angle of the golf club head is to be adjusted. The present invention also is directed to an apparatus and method for protecting a face insert plate of a golf club head, when the lie and/or loft angle of the golf club head is to be adjusted.

In one innovative aspect, the present invention may take the form of a bending plate that may be used to cover a face insert of a golf club head, when the golf club head is placed within a conventional clamping apparatus and forces are applied to the hosel region of the golf club head in an effort to adjust the lie and/or loft angle of the golf club head.

In one preferred form, the bending plate has a first substantially planar surface, or plate section, configured to cover a face region of the golf club head when the golf club head is placed within a clamping apparatus. The bending plate also preferably has an edge engaging section for receiving and abutting an edge of the golf club head when the golf club head is placed within the clamping apparatus. Preferably, the edge engaging section of the bending plate is adapted to detachably engage a top edge portion of the golf club head. The substantially planar surface, or plate section, of the bending plate functions to protect a face insert plate of the golf club head and, moreover, functions to minimize mechanical stresses in a face region of the golf club head when the golf club head is placed in the clamping apparatus and forces are applied to the hosel region of the golf club head. The planar surface, or plate section, of the bending plate also functions to secure the face insert plate within, for example, a face insert receiving cavity of the golf club head and prevents the face insert plate from "popping out" of the face insert receiving cavity when forces are applied to the hosel region of the club head.

In another innovative aspect, the planar surface, or plate section, of the bending plate preferably has a centrally located aperture or "window" formed therein. The centrally located aperture may be used when mounting a club head and associated bending plate within, for example, a conventional clamping apparatus. Moreover, by viewing through the aperture the scorelines provided on the face of a golf club head, it is possible to confirm that the golf club head and associated bending plate are properly positioned within the clamping apparatus.

Those skilled in the art will appreciate that the bending plate may take many forms and that the above-described embodiment represents but one example of those forms. For example, it will be appreciated that, in alternative embodiments the edge-engaging portion of the bending plate could be replaced with raised "finger" elements capable of engaging the top section of a golf club head. Similarly, the substantially planar surface of the bending plate could be replaced with an arrangement of cross-bars or other means for protecting a face insert plate and minimizing mechanical stresses within a face region of the golf club head, when the golf club head is placed in a clamping apparatus and forces are applied to a hosel region of the golf club head.

Accordingly, it is an object of the present invention to provide a bending plate that may be used to minimize mechanical stresses within a face region and face insert plate of a golf club head, when the golf club head is placed in a clamping apparatus and forces are applied to a hosel region of the golf club head.

It is also an object of the present invention to provide improved methods for adjusting the lie and/or loft of a golf club head having a face insert.

Other objects and features of the present invention will become apparent from consideration of the following description taken in conjunction with the accompanying drawings.

BRIEF DESCRIPTION OF THE DRAWINGS

FIG. 1A is a front view of a bending plate in accordance with one preferred form of the present invention.

FIG. 1B is a back view of the bending plate shown in FIG. 1A.

DESCRIPTION OF PREFERRED EMBODIMENTS

Figure 13:
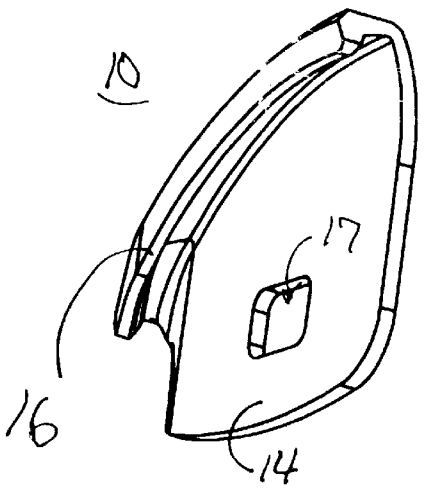
Figure 14:
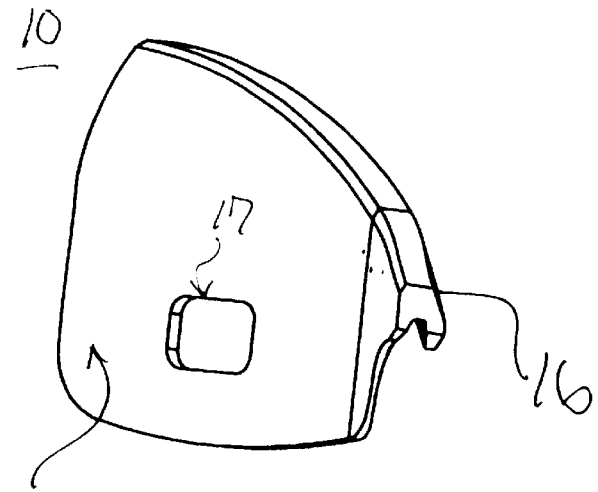

Turning now to the drawings, FIGS. 1A and 1B provide front and back views, respectively, of a bending plate 10 in accordance with a preferred form of the present invention. As shown, the bending plate 10 comprises a substantially planar section 12 including a planar surface 14 for covering a face region of a golf club head and an edge engaging section 16 for detachably engaging a top region of the golf club head. Preferably, an aperture or "window" 17 is centrally located within the planar section 12 of the bending plate 10. The aperture 17 provides a means for viewing the scorelines 19 on a face of a golf club head 20 (shown in FIGS. 2, 3A and 3B), when the golf club head 20 is mounted, for example, within a conventional clamping apparatus 24 (shown if FIGS. 3A and 3B).

Figure 2:
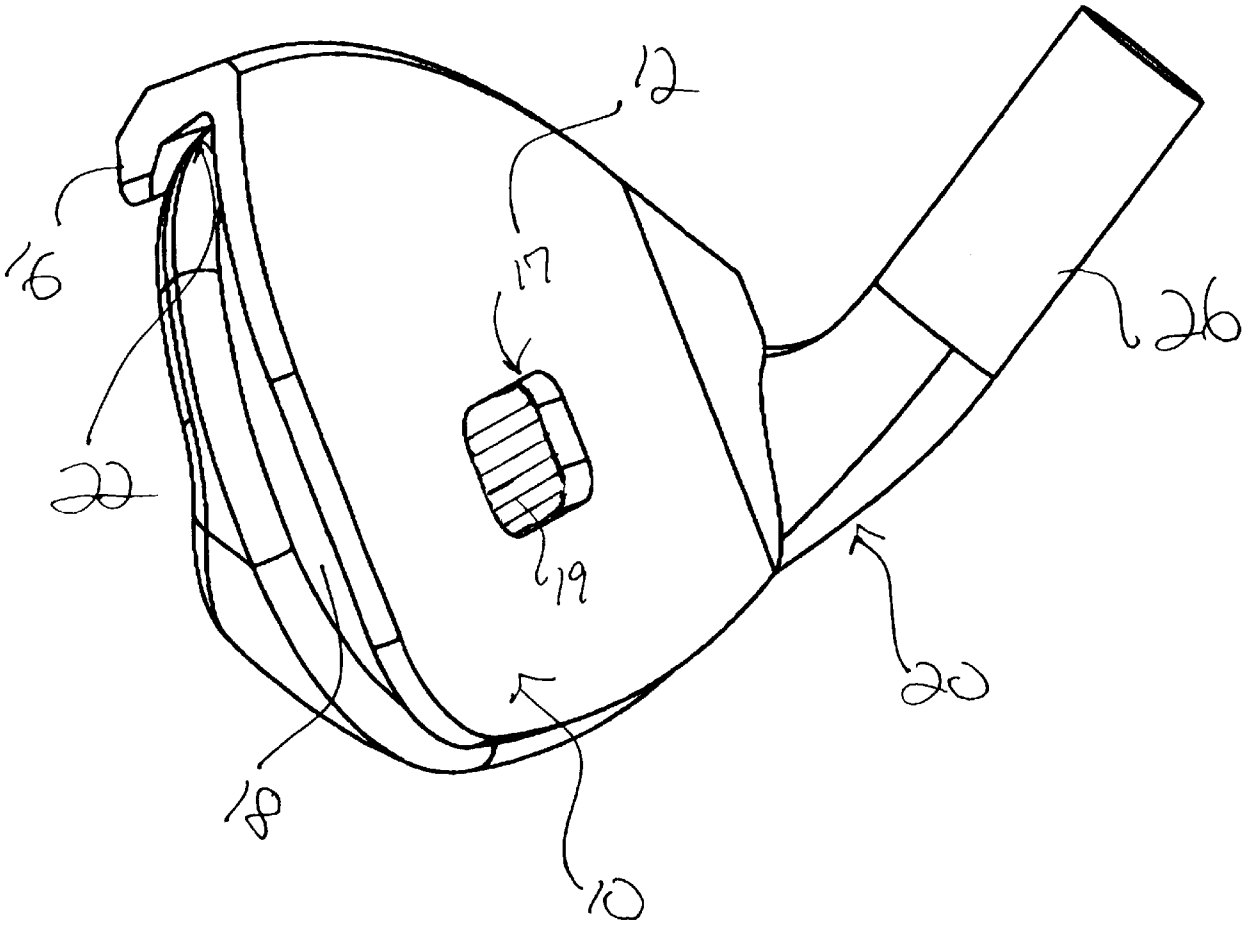
FIG. 2 shows how the bending plate of FIG. 1 may engage an iron type golf club head, such that the golf club head and bending plate may be placed in a conventional clamping tool.
Figure 4:
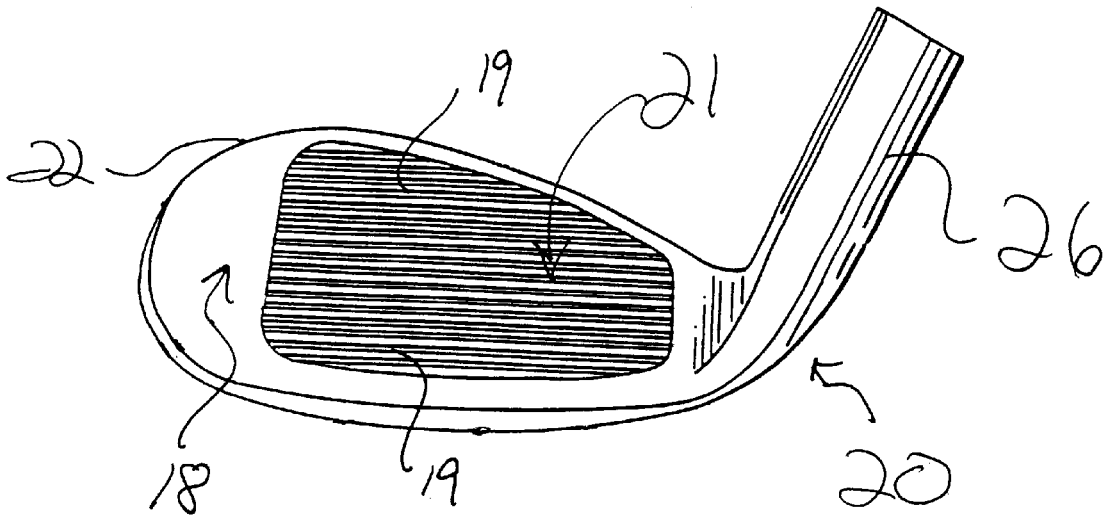
FIG. 4 is an illustration of a golf club head having a face insert plate.

FIG. 2 provides an illustration of a bending plate 10 that has been fitted over a face region 18 of a golf club head 20. As shown in FIG. 2, the planar section 12 of the bending plate 10 covers the majority of the face region 18 of the golf club head 20, and the edge engaging section 16 engages the top section 22 of the golf club head 20. It will be appreciated that in alternative embodiments the edge engaging section 16 of the bending plate 10 could be replaced, for example, by a plurality of raised "fingers" or flanges (not shown), and that the planar section 12 of the bending plate 10 could take the form of a plurality or web of support bars (not shown) that function to protect and reduce mechanical stresses within a face insert plate 21 (shown in FIG. 4) and function to reduce stresses generally within a face insert region of a golf club head when a lie and/or loft angle of the club head is adjusted. Indeed, those skilled in the art will acknowledge that numerous structures could be substituted for the planar section 12 and edge engaging section 16 of a bending plate 10 in accordance with the present invention and, thus, that such structures would be equivalent to the structures described herein. Finally, those skilled in the art will recognize that a bending plate 10 of the type describe herein also could be used to protect face insert plates provided, for example, on wood or putter type golf club heads. However, in the case of wood type golf club heads, the planar section 12 of the face insert plate likely would need to be modified to accommodate the bulge and roll of the face insert plate of the club head.

Figure 3A:
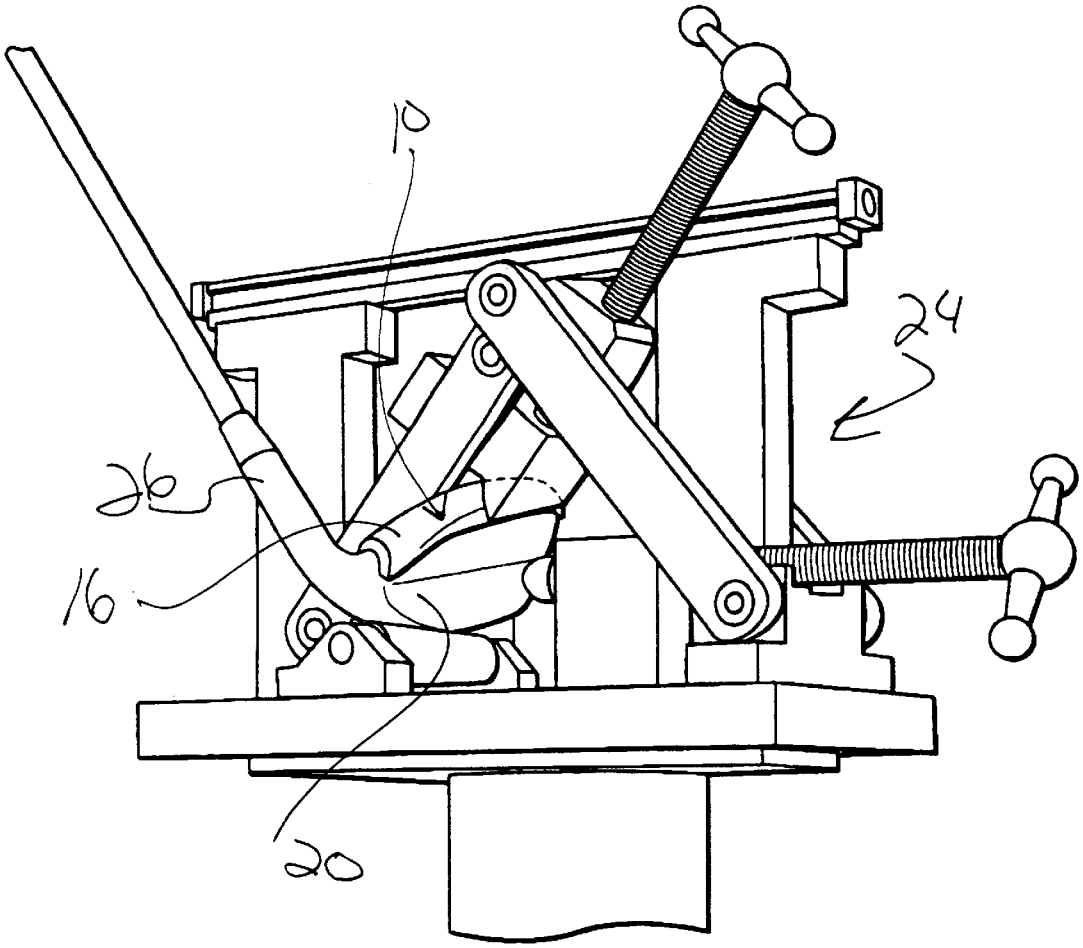
FIGS. 3A and 3B illustrate how a golf club head and bending plate may be held by a conventional clamping tool to enable adjustment of the lie and/or loft of the golf club head.
Figure 3B:
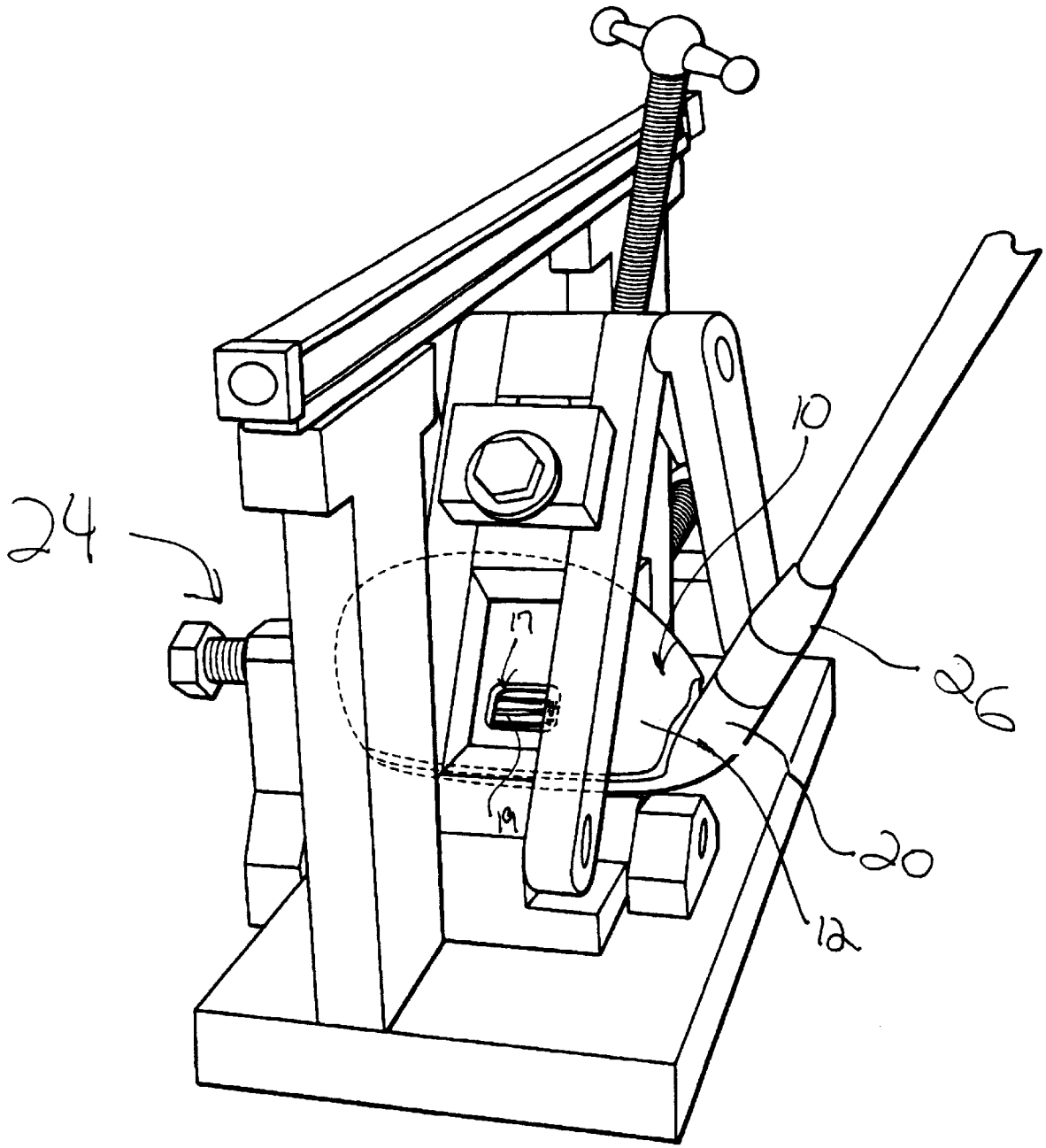

Turning now to FIGS. 3A and 3B, after the bending plate 10 is properly positioned over the face region 18 (shown in FIG. 4) of the golf club head 20 the bending plate 10 and golf club head 20 may be placed in a conventional clamping apparatus 24. Once secured within the clamping apparatus 24, forces may be applied to the hosel region 26 of the golf club head 20 to vary the lie and/or loft of the golf club head 20. Force is applied to the hosel region 26 of the golf club head 20 using a tool (not shown) that is well known in the golf club manufacturing industry. During this process, the bending plate 10 functions to protect the face insert plate 21 (shown in FIG. 4) and to minimize mechanical stresses that might otherwise develop within the face region 18 of the golf club head 20. Thus, through use of a bending plate 10 in accordance with the present invention, it is possible to greatly reduce the occurrence of any damage that may result to the face region 18 and/or face insert plate 21 of a golf club head 20 during a lie and/or loft angle adjustment. This is particularly important to tour players who may wish to have the lie and/or loft angle of, for example, their pitching wedge adjusted during the course of a tournament, but can ill afford to have a club head damaged during the adjustment process.

As noted above, the aperture 17 provided within the planar section 12 of the bending plate 10 provides a means for viewing a plurality of scorelines 19 that may be provided on the face 18 of a golf club head 20 (as shown in FIG. 3B). By viewing the scorelines 19 through the aperture 17, it is possible to assess whether or not a golf club head 20 and associated bending plate 10 are properly positioned or oriented within the clamping apparatus 26.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. An article of manufacture for relieving stresses within a face section of a golf club head when the golf club head is placed within a clamping apparatus for adjustment of a lie or loft angle of the golf club head, said article comprising:

a planar plate covering the face section of the golf club head, thereby reducing a deformity of the face section of the golf club head when the golf club head is placed within the clamping apparatus and a force is applied to a hosel region of the golf club head, and an edge engaging section connected to said planar plate for receiving and abutting a top section of the golf club head to ensure proper positioning between the golf club head and said article of manufacture; and, an aperture centrally located within said planar plate for viewing the scorelines on the face section of the golf club when the golf club is placed within the clamping apparatus.

2. An article of manufacture for relieving stresses within a face section of a golf club head when the golf club head is placed within a clamping apparatus for adjustment of a lie or loft angle of the club head, said article comprising:

a planar plate covering the face section of the golf club head;

said planar plate being substantially planar to the golf club head, thereby minimizing mechanical stresses within the face section of the golf club head when the golf club head is placed within the clamping apparatus and a force is applied to a hosel region of the golf club head;

means for detachably engaging said golf club head; and, an aperture centrally located within said planar plate for viewing the scorelines on the face section of the golf club when the golf club is placed within the clamping apparatus.

* * * * *